US008439460B2

(12) United States Patent
Laible et al.

(10) Patent No.: US 8,439,460 B2
(45) Date of Patent: May 14, 2013

(54) DOMESTIC APPLIANCE FOR INSTALLATION IN A FURNITURE FRAME

(75) Inventors: Karl-Friedrich Laible, Langenau (DE); Helmut Steichele, Lauingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 211 days.

(21) Appl. No.: 12/497,771

(22) Filed: Jul. 6, 2009

(65) Prior Publication Data

US 2010/0045151 A1 Feb. 25, 2010

(30) Foreign Application Priority Data

Aug. 22, 2008 (DE) ..... 10 2008 041 488

(51) Int. Cl.
*A47B 96/00* (2006.01)

(52) U.S. Cl.
USPC ..... 312/401; 312/204; 312/265.6

(58) Field of Classification Search ..... 312/107, 312/111, 198, 204, 245, 257.1, 400, 401, 312/406, 265.1, 265.2, 265.3, 265.4, 265.6; 52/287.1, 288.1, 290, 716.1, 718.01, 718.04; 403/329; 24/293, 294, 295
See application file for complete search history.

(56) References Cited

U.S. PATENT DOCUMENTS 1,440,948 A * 1/1923 Aiken ..... 109/49
1,690,286 A * 11/1928 Fitch et al. ..... 108/153.1
2,078,581 A * 4/1937 Muller ..... 312/265.1
2,101,349 A * 12/1937 Sharp ..... 403/280
2,225,394 A * 12/1940 Tinnerman ..... 24/295
2,644,607 A * 7/1953 Hinkel ..... 220/592.08
2,751,106 A * 6/1956 Schrader ..... 220/592.07
2,973,235 A * 2/1961 Saunders ..... 312/204
3,070,852 A * 1/1963 Hilliker ..... 49/366
3,170,743 A * 2/1965 Martiniak ..... 312/213
3,301,622 A * 1/1967 Dasovic et al. ..... 312/245
3,313,065 A * 4/1967 Sandin ..... 49/460
3,346,316 A * 10/1967 Morioka et al. ..... 312/265.4
3,351,400 A * 11/1967 Sholtes ..... 312/111
3,380,615 A * 4/1968 Kessler ..... 220/592.06
3,392,720 A * 7/1968 Sherman ..... 126/211
3,501,186 A * 3/1970 Trump et al. ..... 52/718.05
3,675,955 A * 7/1972 Hajduk ..... 217/65
3,773,399 A * 11/1973 Sulcek ..... 312/204
3,814,491 A * 6/1974 Kackley ..... 312/257.1
3,995,922 A * 12/1976 Ohashi ..... 312/265.5
4,099,812 A * 7/1978 Morphy ..... 312/406.2
4,162,571 A * 7/1979 Horvay ..... 29/460
4,583,796 A * 4/1986 Nakajima et al. ..... 312/405
4,732,432 A * 3/1988 Keil et al. ..... 312/406.2

(Continued)

FOREIGN PATENT DOCUMENTS

DE 10-2005057160.3 * 5/2007
JP 3181770 * 8/1991

(Continued)

*Primary Examiner* — James O Hansen
*Assistant Examiner* — Kimberley S Wright
(74) *Attorney, Agent, or Firm* — James F. Howard; Andre Pallapies

(57) ABSTRACT

A domestic appliance for installation in a furniture frame, the appliance includes an essentially rectangular body, and two vertical cover sections affixed to the front vertical edges of the body, which extend laterally beyond the vertical edges onto the furniture frame. A horizontal cover section is pushed in between the vertical sections along an upper front edge of the body.

12 Claims, 3 Drawing Sheets

U.S. PATENT DOCUMENTS

| | | | | | |
|---|---|---|---|---|---|
| 4,820,372 | A * | 4/1989 | Gidseg | 156/356 |
| 4,948,206 | A * | 8/1990 | Fitzpatrick | 312/296 |
| 4,949,519 | A * | 8/1990 | Jeffers | 52/239 |
| 5,265,954 | A * | 11/1993 | Keil | 312/405 |
| 5,346,296 | A * | 9/1994 | Kelley | 312/198 |
| 5,350,227 | A * | 9/1994 | Katz | 312/198 |
| 5,358,326 | A * | 10/1994 | Cherry et al. | 312/405 |
| 5,564,808 | A * | 10/1996 | Gipson et al. | 312/405 |
| 5,720,536 | A * | 2/1998 | Jenkins et al. | 312/406.2 |
| 5,809,714 | A * | 9/1998 | Kurrasch et al. | 52/239 |
| 5,921,095 | A * | 7/1999 | Lee et al. | 62/175 |
| 6,056,383 | A * | 5/2000 | Banicevic et al. | 312/406 |
| 6,178,700 | B1 * | 1/2001 | Mayer, Jr. | 49/504 |
| 6,266,244 | B1 * | 7/2001 | Guthrie | 361/704 |
| 6,312,068 | B1 * | 11/2001 | Benner et al. | 312/111 |
| 6,341,457 | B1 * | 1/2002 | Aerts et al. | 52/239 |
| 6,550,879 | B1 * | 4/2003 | Kurrasch et al. | 312/257.1 |
| 6,902,068 | B1 * | 6/2005 | Fontana et al. | 211/26 |
| 6,964,131 | B2 * | 11/2005 | Herrmann et al. | 49/193 |
| 6,997,530 | B2 * | 2/2006 | Avendano et al. | 312/401 |
| 7,194,792 | B2 * | 3/2007 | Grace et al. | 29/434 |
| 7,293,847 | B2 * | 11/2007 | Lee et al. | 312/406.2 |
| 7,516,531 | B2 * | 4/2009 | Crompton et al. | 29/428 |
| 7,665,810 | B2 * | 2/2010 | Crompton et al. | 312/204 |
| 7,845,745 | B2 * | 12/2010 | Gorz et al. | 312/401 |
| 8,079,652 | B2 * | 12/2011 | Laible et al. | 312/242 |
| 2003/0044230 | A1 * | 3/2003 | Pally et al. | 403/329 |
| 2003/0222547 | A1 * | 12/2003 | Trees | 312/204 |
| 2004/0041503 | A1 * | 3/2004 | Lee | 312/406 |
| 2006/0103282 | A1 * | 5/2006 | Avendano et al. | 312/401 |
| 2008/0000258 | A1 * | 1/2008 | Benz et al. | 62/447 |
| 2008/0042537 | A1 * | 2/2008 | Kim et al. | 312/405 |
| 2008/0120912 | A1 * | 5/2008 | Crompton et al. | 49/372 |
| 2009/0151385 | A1 * | 6/2009 | Hagele et al. | 62/298 |
| 2009/0165268 | A1 * | 7/2009 | Laible et al. | 24/589.1 |
| 2009/0252548 | A1 * | 10/2009 | Laible et al. | 403/291 |
| 2009/0261703 | A1 * | 10/2009 | Kentner et al. | 312/405 |
| 2009/0267468 | A1 * | 10/2009 | Laible et al. | 312/237 |
| 2010/0045150 | A1 * | 2/2010 | Laible et al. | 312/237 |
| 2011/0030188 | A1 * | 2/2011 | Ciyanoglu et al. | 29/426.2 |

FOREIGN PATENT DOCUMENTS

| | | | |
|---|---|---|---|
| KR | 20030057087 | * | 7/2003 |
| WO | WO 2007062948 A1 | * | 6/2007 |
| WO | WO-2007062928 | * | 7/2007 |
| WO | WO-2007122072 | * | 11/2007 |

* cited by examiner

DOMESTIC APPLIANCE FOR INSTALLATION IN A FURNITURE FRAME

BACKGROUND OF THE INVENTION

This invention relates to a domestic appliance suitable for installation in furniture frames of varying designs.

Whilst in Europe a furniture niche for installation of a domestic appliance has even lateral walls made of wood or layered chipboard with a constant thickness of typically 16 mm to 19 mm, whose front edges form one of the frames surrounding the niche, in the USA in particular, forms of construction also known as "face-frame kitchen" are widespread, wherein an installation niche has a stable frame made from solid wood at the front, but behind it has lateral walls made from a thin-walled composite material of lesser strength.

The body of a domestic appliance that is to be mounted in such a furniture niche irrespective of design, must be a certain degree smaller than the frame. It is known for two cover sections that extend beyond the front vertical edges of the body to be provided on the body of such a domestic appliance, which—in the finished, installed state—are in contact with the front of the frame of the niche and thus conceal any gap between the lateral walls of the niche and those of the body. In order to install the domestic appliance in the furniture niche in a stable manner, the cover sections must also be screwed to the frame. In a kitchen of the European design described above, a fixing screw which is screwed through a hole in a cover section from the lateral direction into the lateral wall of the niche must maintain sufficient distance from the front edge of the lateral wall to ensure that the latter is not ruptured by the screw. In a kitchen of the "face-frame" type, however, a correspondingly placed screw does not go in the frame but in the lateral wall board located behind it, which does not offer any hold. In this case a screw must be driven into the solid wooden frame. Since the positioning of the screws in the profile sections depends on the design of the kitchen yet visible empty screw holes are felt to be aesthetically displeasing, it is generally left to the domestic appliance installer to drill appropriate holes in the cover sections for the respective kitchen type. The manual labor associated with this makes installing the appliance more expensive for the customer, and entails a not insignificant risk that damage may occur to the profile sections or the furniture frame as a result of incorrect procedure.

Devices are also known in which a connected frame is provided at the location of the two vertical cover sections, the frame extending along the vertical edges and the upper horizontal edge of the front surface of the body. However, this presents the problem in that production tolerances in the dimensions of the body or the frame cannot be compensated for and are clearly visible. A side-by-side installation of several appliances is not possible without destroying the frame or preparing a costly special frame for adjacently located appliances.

BRIEF SUMMARY OF THE INVENTION

One object of the invention is to produce a domestic appliance with a frame construction that is simple to install and use and is insensitive to dimensional tolerances.

This object is achieved wherein, in a domestic appliance for installation in a furniture frame, in particular a refrigerator, having an essentially rectangular body and two vertical cover sections which are fixed to the front vertical edges of the body and extend laterally beyond the vertical edges onto the furniture frame along an upper front edge of the body, a horizontal cover section is pushed in between the vertical cover sections. If the section turns out on installation of the appliance to be slightly longer than the upper front edge when the appliance is installed, it many be easily shortened and without prejudicing the appearance of the device once installed; if the horizontal cover section is slightly smaller the gap between it and the two vertical cover sections may be shared so that each individual gap is small and insignificant.

To ensure that any such gaps are inconspicuous, it also helps if the horizontal cover section is moved back against the vertical cover sections.

A door to the domestic appliance advantageously conceals the horizontal cover section when in the closed state.

In order to fasten the body to the furniture niche it is advantageous to provide a height-adjustable bracket on the upper front edge of said furniture niche. This eliminates the need to screw the vertical cover sections to the furniture frame, thus also removing the problems inherent in placing screw holes in the vertical cover sections.

The bracket advantageously includes a head piece, in which a screw hole is formed, a connecting piece and the connecting piece with the head piece and with the flexible weak point connecting it to the body. By bending the weak point the connecting piece may be positioned at various diagonal angles as required in order to overcome any variable difference in height between the top surface of the body and a part of the furniture frame running over it, whilst the head piece in this part of the furniture frame can be screwed flush—and, therefore, securely—to the system.

The bracket should have several screw holes with varying depth levels, to provide the installer of the appliance with an appropriately placed screw hole depending on the type of furniture frame.

The horizontal cover section is advantageously attached by placing it on the bracket. This is particularly easy if an area of the bracket surrounding the central projection overlaps the furniture frame by a distance, whilst the screwed projection touches the furniture frame and the horizontal cover section can be pushed into the gap.

To facilitate a large overlap between the bracket and cover section in the downward direction, the cover section advantageously has a recess which accommodates the projection.

In a preferred embodiment the horizontal cover section therefore has a groove open at the rear, in which the bracket engages, and the projection is formed in an upper wall enclosing the groove. Thus in the assembled state, the bracket is concealed at least partially on the inside of the horizontal cover section.

A lower wall enclosing the groove advantageously touches the front surface of the body in a stop position, in order completely to conceal the bracket and the screws connecting it to the furniture frame.

In order to keep the horizontal cover section secure, several brackets are advantageously provided. These brackets are effectively arranged on a grid with a grid width corresponding to an integral part of the width of the body. This facilitates in particular the installation of side-by-side appliances, since horizontal cover sections for adjacently installed appliances may be cut to length from the same continuous profile material that is also used for installation of the individual appliances separately.

BRIEF DESCRIPTION OF THE DRAWINGS

Further features and advantages of the invention are revealed in the following description of exemplary embodiments with reference to the attached diagrams.

In which.

DETAILED DESCRIPTION OF THE PRESENT INVENTION

Figure 1:
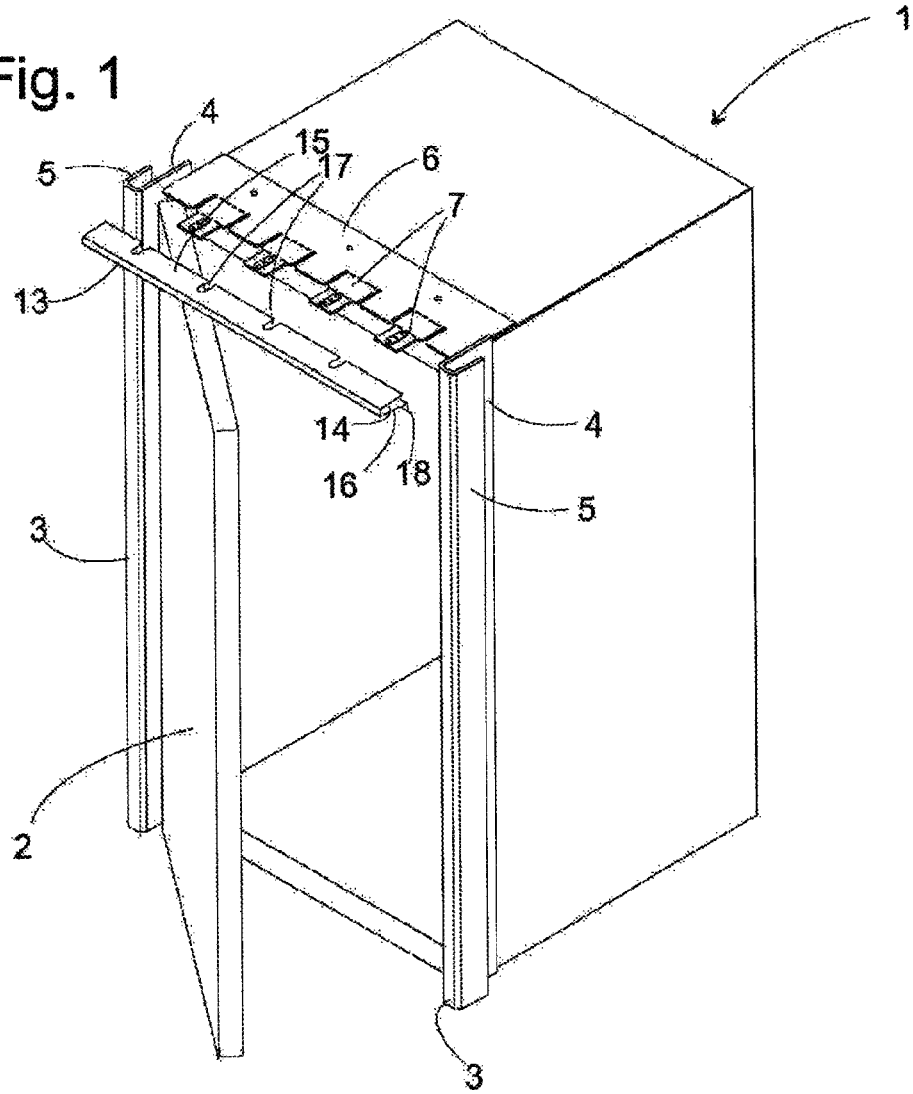
FIG. 1 shows a schematic perspective view of a refrigerator according to the present invention.

A door 2 is fixed at the front of the rectangular body of the refrigerator shown in FIG. 1. On the front edges of the lateral walls of the body 1, two U-shaped cover sections 3 are attached symmetrically in relation to one another, with one leg 4 of each U shape 3, which touches the lateral wall and is attached to it, being longer than the opposite leg 5 which faces away from the lateral wall. Since the backward edges of the outer leg 5 push against the front surface of one of the mobile frames surrounding the niche when the body 1 is placed in a furniture niche, they conceal a gap between it and the body 1.

Figure 2:
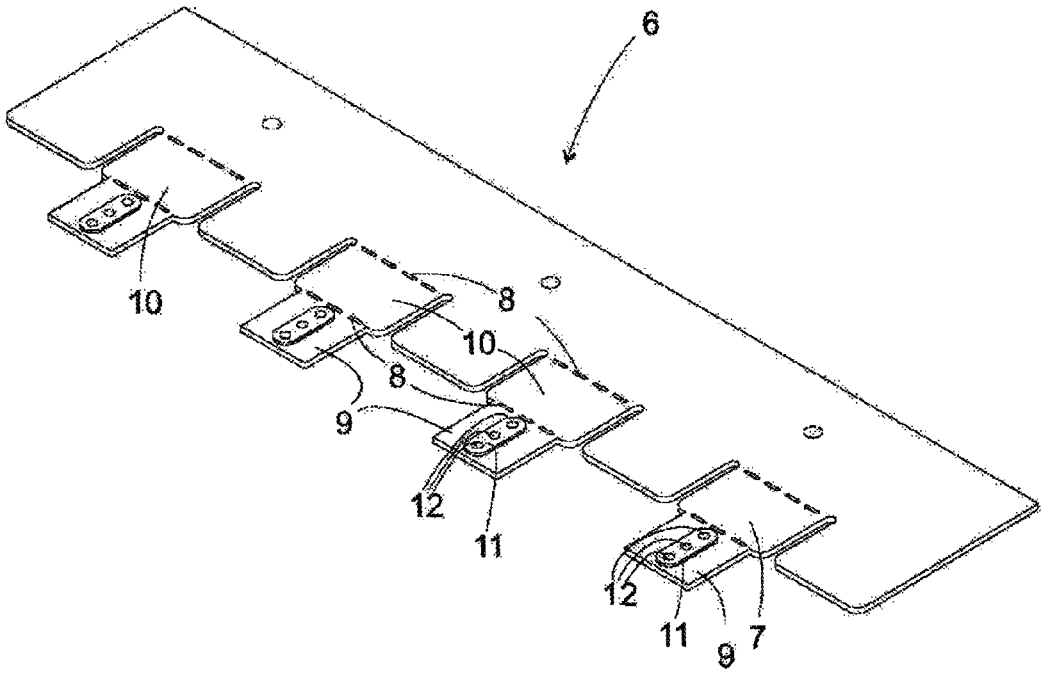
FIG. 2 shows a perspective view of an adapter plate which is used to fasten the refrigerator into a furniture niche with simultaneous balancing of height tolerances.

A tin adapter plate 6 is screwed to the upper surface of the body 1, said adapter plate being shown enlarged in FIG. 2. On the front edge of the adapter plate 6 a plurality of brackets 7 are cut free. Each of the brackets 7 projects beyond the front surface of the body 1 but not beyond the front edges of the vertical cover sections 3. The brackets 7 each have two flexible weak points, which are formed by a number of slots 8 stamped along a line. One of these weak points 8 delimits the bracket 7 from the main part of the adapter plate 6; the other subdivides the bracket 7 into a head piece 9 and a connecting piece 10.

A projection 11 extending downward is stamped into each head piece 9, and several downward graduated screw holes 12 are formed in the projection 11.

A horizontal cover section 13, which is provided for attaching to the brackets 7 of the body 1 mounted in a furniture niche, is shown in FIG. 1 separated from the body 1. This horizontal cover section 13 is a unitary, one-piece structure with an essentially U-shaped cross-section and essentially horizontally oriented legs 15, 16, which form the boundary of a groove 14 facing toward the brackets 7.

The upper leg 15 is provided with several equally spaced slots 17 which are open at the edge. The lower leg 16 has a downward angled plate 18 on its rearward edge.

Figure 3:
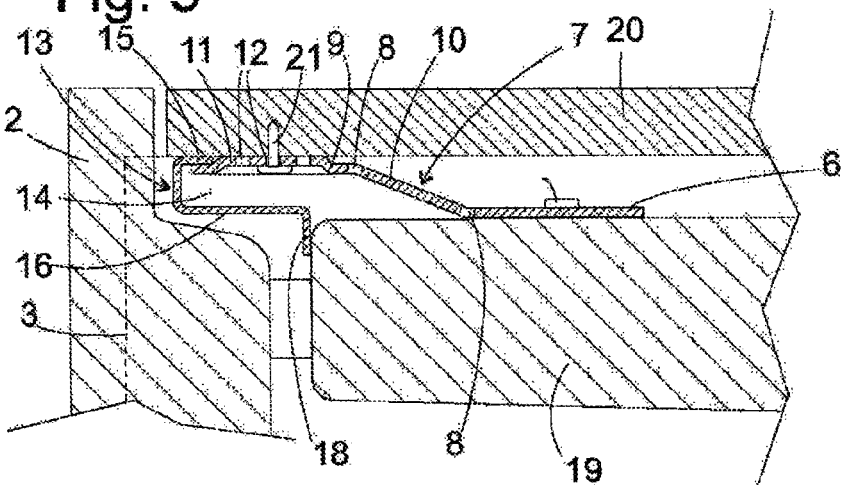
FIG. 3 shows a vertical partial section through the refrigerator, installed in an installation niche of European design type.

FIG. 3 shows a section through the upper front edge of the body 1, mounted in a kitchen cabinet of the European type. A ceiling of the body 1 is labeled 19, and a ceiling of the installation niche is labeled 20. The bracket 7 shown in cross-section is angled along its slots 8, so that the diagonally positioned connecting piece 10 bridges a gap between the ceiling 19 of the body and the ceiling 20 of the installation niche. A screw 21 crosses one of the screw holes 12 in the bracket 7 and is anchored in the ceiling 20. The screw 21 is located in one of the rearward screw holes 12 in the bracket 7 in order to maintain sufficient distance from the front edge of the ceiling 20 so that, when the screw is tightened, there is no risk that fragments will become displaced from the ceiling 20.

The horizontal cover section 13 is pushed in between the head piece 9 and the ceiling 20, with the projection 11 of the head piece engaging into one of the slots 17. The slot 17 is slightly wider than the projection 11 engaging in it, so that clearance is maintained when the two engage into one another in the widthwise direction of the body 1. This results in the possibility of moving the cover section 13 sideways slightly, if it is smaller when it engages between the two vertical cover sections 3. A stop position of the cover section 13 in the downward direction is defined by the contact of its plate 18 with the front surface of the body 1.

The front edge of the cover section 13 does not extend beyond the front edge of the ceiling 20. The door 2 may therefore have a décor plate, which extends vertically beyond the ceiling 20 and, in the closed position, as shown in FIG. 3, completely conceals the cover section 13.

The vertical cover section 3 shown in the view in FIG. 3 as being concealed by the door 2 is shown by a hatched line in order to indicate that a front edge of this cover section 3 protrudes forward beyond the front edge of the ceiling 20, so that the legs 4 of this cover section 3 that are turned toward one another define a distance from the horizontal cover section 13 that is to be filled as precisely as possible.

Figure 4:
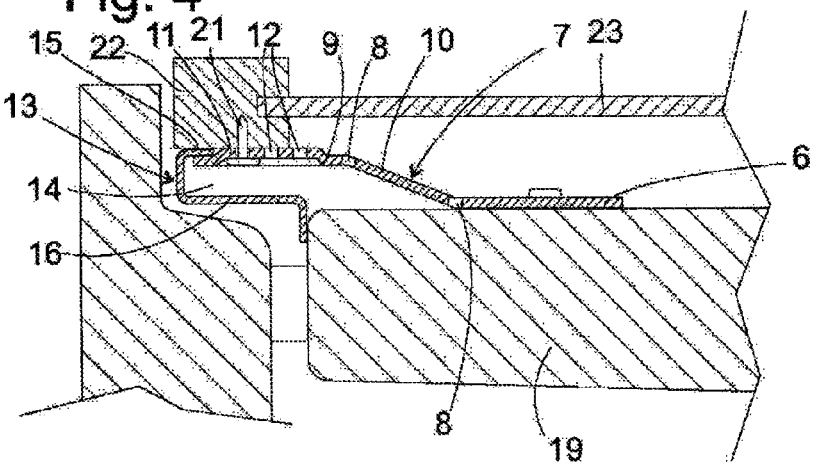
FIG. 4 shows a section analogous to FIG. 3, which shows the installation in an installation niche of the "face-frame" type.

FIG. 4 shows a section analogous to FIG. 3 through the refrigerator installed in a niche of the "face-frame" type. In this case, the screw 21 which fixes the bracket 7 to the installation niche is inserted in the frontmost screw hole 12 of the bracket 7 and engages centrally into a solid wood bar 22 in a front edge of the installation niche. If the screw 21 were inserted into the center screw hole 12 as shown in FIG. 3, it would probably cause part of the bar 22 to split off. The back screw hole 12 is located against a thin plate 23 made of composite material and forming the rear part of the installation niche, separated from it by an air gap; screws cannot be inserted here.

Figure 5:
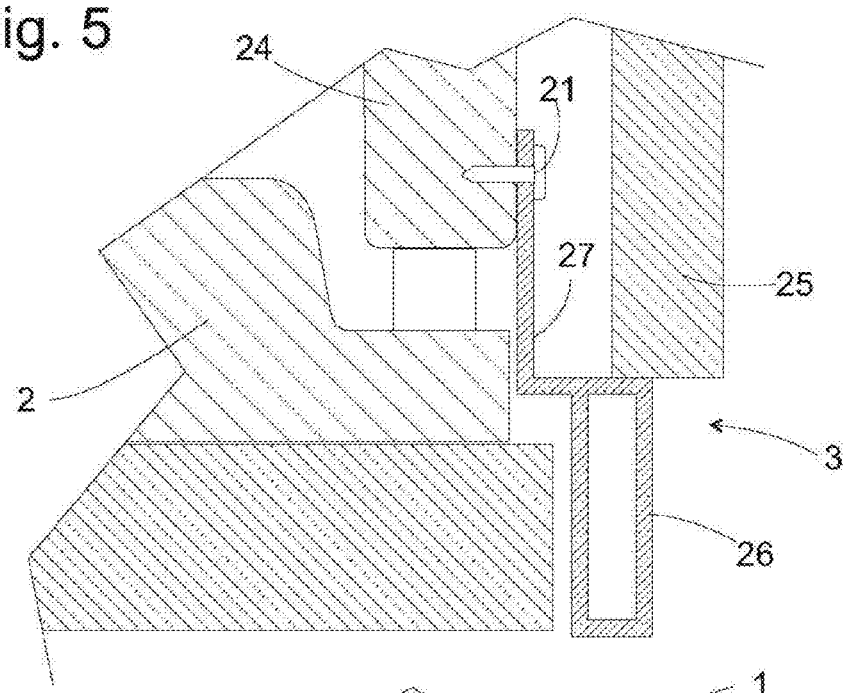
FIG. 5 shows a horizontal, detailed section through the refrigerator and an accommodating installation niche.

FIG. 5 shows a horizontal section through the front area of a lateral wall 24 of the body 1 and a lateral wall 25 of the installation niche. The lateral wall 25 shown is, like the ceiling 20 in FIG. 3, a wooden panel, in particular a chipboard panel, of constant strength, however a construction according to FIG. 4 with a wooden bar 22 forming a frame and a thin board 23 attached to it could be used just as well instead.

The vertical cover section 3 shown in cross-section comprises a front rectangular section 26 and an L-profile section 27 attached to a corner of the rectangular section 26. A long leg of the L-profile section 27 extends along the lateral wall 24 of the body 1 and is screwed to it. The other leg of the L-profile section 27 and a narrow end of the rectangular section 26 that extends it bridge a gap between the lateral walls 24, 25 and rest on the front edge of the lateral wall 25. Since the body 1 is fixed to the installation niche along its upper front edge with the help of the brackets 7 and is stabilized, it is not necessary for the cover sections 3 to be permanently connected to the lateral walls 25 of the installation niche. Thus the visible surfaces of the cover sections 3 are not defaced by manually drilled holes.

Figure 6:
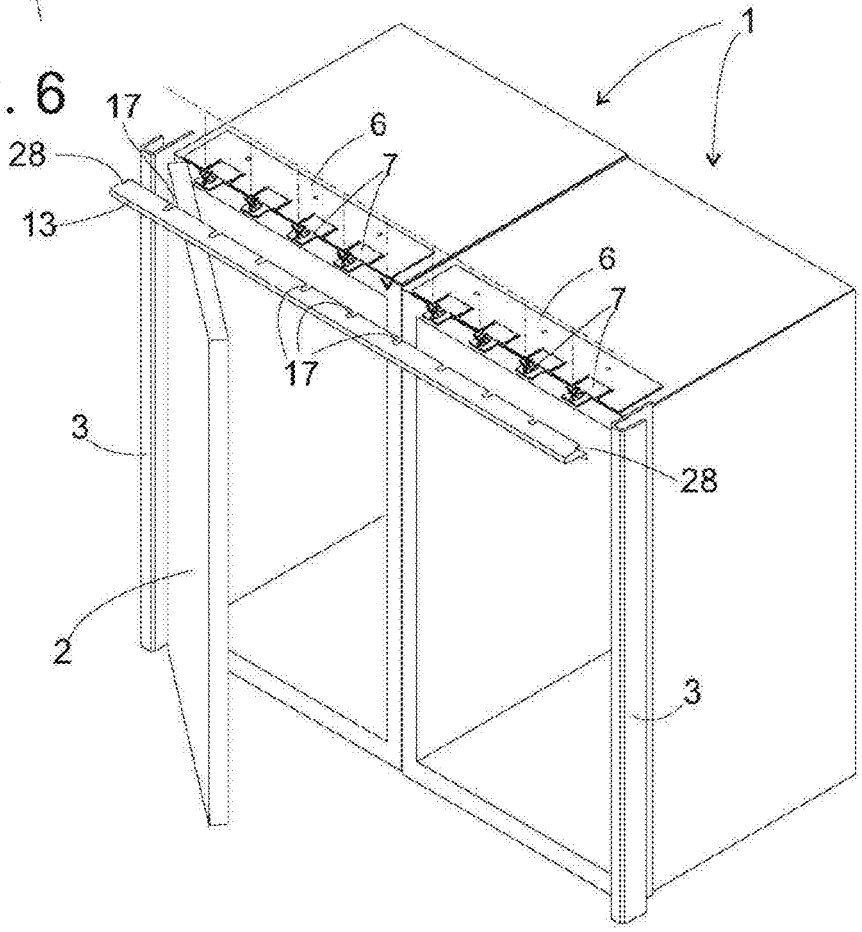
FIG. 6 shows a perspective view of an inventive side-by-side appliance.

FIG. 6 shows a perspective view of an inventive refrigerator in a side-by-side arrangement. Two bodies 1 shown as identical here for the sake of simplicity each have an adapter plate 6 with a grid of one fifth of the brackets 7 allocated to the body width in the example under consideration. The grid of brackets 7 effectively corresponds to the difference in width between bodies of a manufacturer's different refrigerator models, so the same horizontal cover section, cut to an appropriate length and bearing adapter plates 6 each with different quantities of brackets 7, can be used for all these models. The distance between two adjacent brackets 7 of different adapter plates 6 is twice as large as between the brackets 7 of an identical adapter plate 6. If two bodies 1 are placed in the same niche—with vertical cover sections 3 placed on only one side and their brackets 7 firmly screwed down, it is therefore possible for a horizontal cover section 13 to be put together on the brackets 7 of both adapter plates 6, in which horizontal cover section all slots 17 are formed equidistantly corresponding to one fifth of the body width. The cover section 13 for the side-by-side placement can therefore be cut to an appropriate length from continuous material, like the cover section 13 for a single body.

A further simplification of the cover section 13 is achieved wherein the brackets 7 as shown in FIG. 6, are arranged symmetrically to a vertical center plane of each body 1. The effect of this is that the slots 17 also come to rest at the level of each of the lateral outer surfaces of the bodies 1. These slots thus at the same time mark the points at which the continuous section must be cut in order to obtain a cover section of the correct length. Cut slots are therefore always found at the ends of the correctly cut cover section 13.

The invention claimed is:

1. A domestic appliance for installation in a furniture frame, the appliance comprising:

an essentially rectangular body;

two vertical cover sections affixed to front vertical edges of the body, which extend laterally beyond the vertical edges onto the furniture frame, the vertical cover sections each having a rectangular section abutting the frame at various positions thereacross and an L-profile section attached to a corner of the rectangular section and fixed to the body;

a bracket mounted to an upper front edge of the body for fixing to the furniture frame; and a horizontal cover section formed as a generally U-shaped one-piece member extending between the bracket and the front surface of the body, the U-shaped member having two horizontally oriented legs defining a groove facing the bracket and a planar front face presenting a continuous smooth surface facing away from the bracket with one leg connected to the bracket and the other leg terminating in a downwardly directed plate extending from a rearward edge thereof, with an outwardly directed surface of the downwardly directed plate abutting the front surface of the body at various positions therealong; the horizontal cover section extending laterally from one vertical cover section to the other along the upper front edge of the body between the vertical cover sections and the vertical cover sections covering a vertical gap between the body and the frame wherein the horizontal cover section acts with the vertical cover sections to provide a cover that has a uniform, smooth outwardly-directed surface.

2. The domestic appliance of claim 1, wherein the horizontal cover section is in abutment with at least one of the vertical cover sections.

3. The domestic appliance of claim 1, wherein the bracket is formed as a height-adjustable bracket.

4. The domestic appliance of claim 3, wherein the bracket has a head piece with a screw hole formed therein, and a connecting piece formed with flexible junctions that connect the head piece and the body.

5. The domestic appliance of claim 3, wherein the bracket has several screw holes formed therein with at least two different depths.

6. The domestic appliance of claim 3, wherein the bracket includes at least one screw hole for fixing the bracket to the furniture frame formed in a central projection of the bracket.

7. The domestic appliance of claim 6, wherein the horizontal cover section is mounted to the bracket.

8. The domestic appliance of claim 7, wherein the horizontal cover section has a recess, which accommodates the projection.

9. The domestic appliance of claim 8, wherein the horizontal cover section has a groove, which is open at the rear, in which the bracket engages, and wherein the projection is formed in an upper wall which encloses the groove.

10. The domestic appliance of claim 9, wherein a lower wall limiting the groove in a stop position is in abutment with a front surface of the body.

11. The domestic appliance of claim 1, wherein the appliance further comprises several brackets which are arranged to correspond to an integral part of the width of the body.

12. The domestic appliance of claim 1, wherein the body comprises two parts arranged adjacent to one another.

* * * * *